US006115854A

United States Patent [19]

Haghayegh

[11] Patent Number: 6,115,854

[45] Date of Patent: Sep. 12, 2000

[54] BIDET ACCESSORY FOR TOILETS WITH FRAGRANCE DISPENSER

[76] Inventor: Alireza Haghayegh, 12721 NW. 7th Ave., Miami, Fla. 33168

[21] Appl. No.: 09/371,890

[22] Filed: Aug. 9, 1999

[51] Int. Cl.[7] ..... A47K 3/22; A47K 3/26; A61H 35/00

[52] U.S. Cl. ..... 4/443; 422/125; 4/420.2; 4/615

[58] Field of Search ..... 4/420.2, 443, 446, 4/615, 616; 392/390, 441, 449–454, 485; 239/34, 60; 422/125, 305, 306

[56] References Cited

U.S. PATENT DOCUMENTS

| | | | |
|---|---|---|---|
| 5,093,943 | 3/1992 | Wei | 4/615 |
| 5,271,104 | 12/1993 | La Tora | 4/420.4 |
| 5,993,748 | 11/1999 | Wheeler | 422/125 |

*Primary Examiner*—Henry J. Recla
*Assistant Examiner*—Tuan Nguyen
*Attorney, Agent, or Firm*—J. Sanchelima

[57] ABSTRACT

A bidet assembly connected to a tap water supply such as those used for toilet fixtures. A user utilizes a bidet assembly with a conventional toilet and is provided with a fragrance dispensing assembly that is heat sensitive to evaporate preselected fragrances. The heat is obtained from a cut out in the electrically heated water holding tank so that sufficient heat is transferred to activate the fragrance dispenser.

5 Claims, 2 Drawing Sheets

BIDET ACCESSORY FOR TOILETS WITH FRAGRANCE DISPENSER

BACKGROUND OF THE INVENTION

1. Field of the Invention

The present invention relates to bidet assembly, and more particularly, to a bidet accessory for toilets with a fragrance dispenser.

2. Description of the Related Art

There are many designs of bidet assemblies that work in conjunction with or closely associated with toilet fixtures. Only a few include means for providing lukewarm water and these typically require rather complicated plumbing connections. The closest reference known to applicant corresponds to U.S. Pat. No. 5,271,104 issued to La Tora in 1993. It differs from the present invention in that it lacks a fragrance dispenser, like in the present invention, wherein part of the heat generated to keep the water lukewarm is used to activate the fragrance dispenser.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a bidet assembly that can be readily adapted to conventional toilet fixtures with minimum of plumbing connections and to dispense fragrances.

It is another object of this invention to provide a bidet assembly that can readily provide lukewarm water to a user at all times with minimal consumption of electrical energy.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
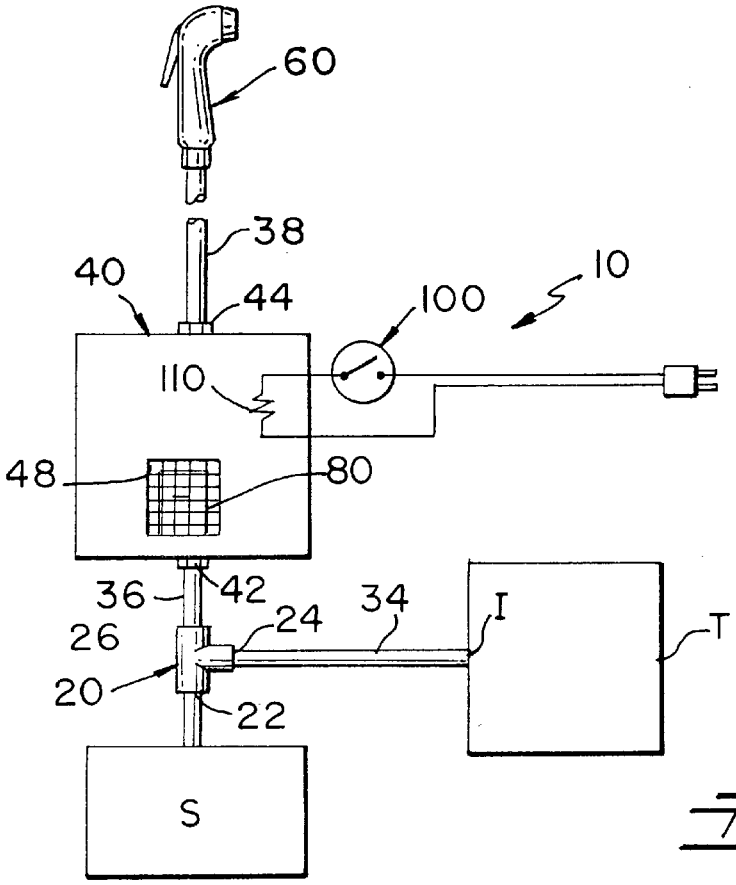
FIG. 1 is a block diagram representation of the circuit used in one of the preferred embodiments.
Figure 2:
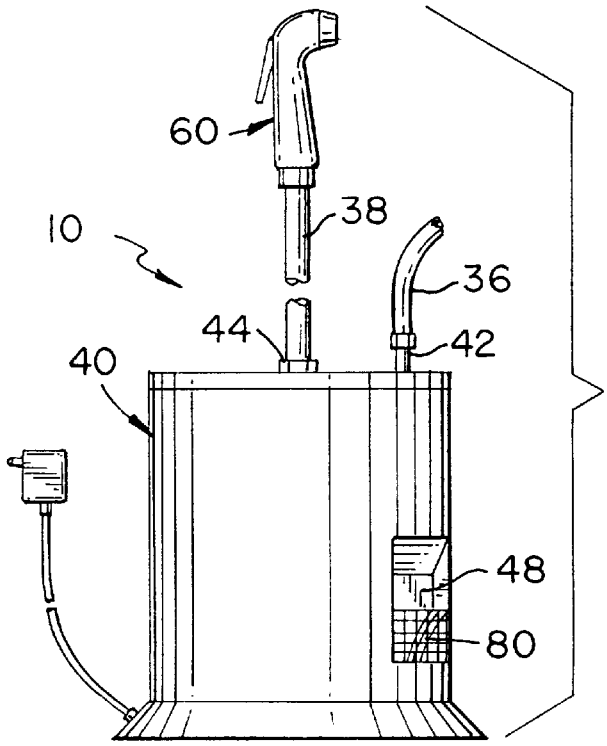
FIG. 2 is a pictorial representation of the components of one of the preferred embodiments for the present invention.
Figure 3:
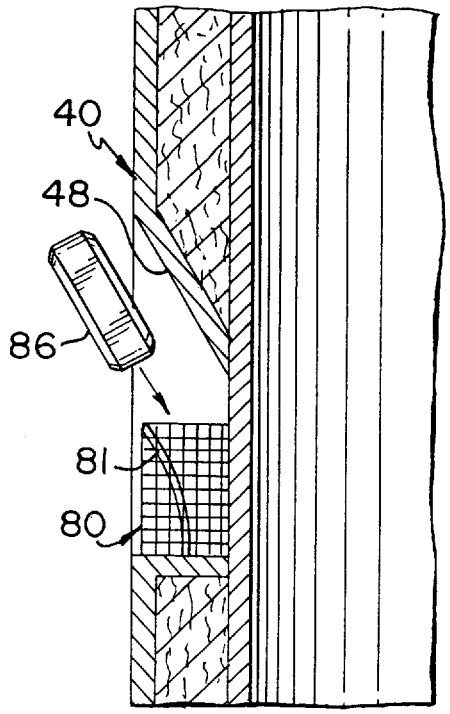
FIG. 3 shows a sectional view of the cut-out with fragrance dispenser assembly.

Referring now to the drawings, where the present invention is generally referred to with numeral 10, it can be observed that it basically includes T-connector 20 connected to a tap water supply S, toilet inlet I and holding tank 40, nozzle valve assembly 60 connected to the outlet 44 of tank 40 and fragrance dispensing assembly 80 that uses the relatively higher temperature of the water contained inside tank 40.

T-connector 20 includes three connecting ports 22; 24 and 26 that are connected, respectively to tap water supply S, conduits 34 and 36. Conduit 34 connects, at the other end, to toilet inlet I providing the required tap water for the conventional operation of toilet fixture T. Conduit 36 connects port 26 to inlet 42 of holding tank 40.

Holding tank 40 has a cylindrical shape, in the preferred embodiment, and it is made out of an insulating material with low thermal conductivity. Holding tank 40 includes an electric heating assembly 110 for raising the temperature of the water contained therein. Thermostat assembly 100 allows a user to adjust the temperature of the water. A window or cut-out 48 is provided for mounting fragrance dispensing assembly 80 so that it avoids the insulating material and comes thermally closer to the water in tank 40. Frangrance dispensing assembly 80 includes resilient spring leaf 81 to press temperature sensitive fragrance tablet 86 against surface of water tank 40 in window cut-out 48. In that manner, sufficient heat from the water is transferred to assembly 80 thus facilitating the emission of selected fragrances.

Valve 60 is hand activated and connected to tank 40 through conduit or connector 38. The tap water pressure coming in through inlet 42 is transmitted to outlet 44 to provide sufficient pressure for the water to come out.

Figure 4:
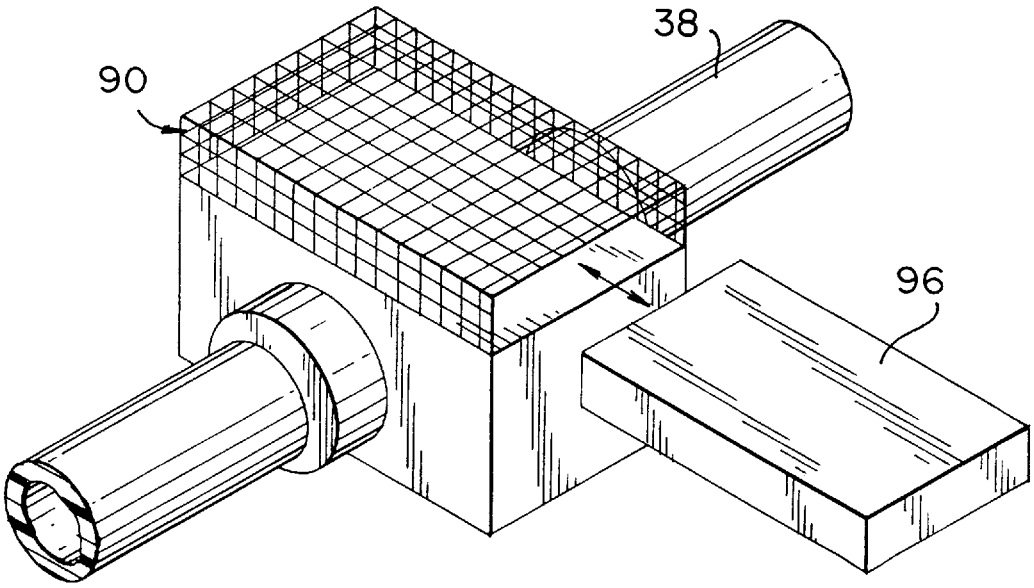
FIG. 4 represents an isometric view of the alternate fragrance dispenser assembly.

An alternate embodiment is shown in FIG. 4, wherein the fragrance is heated only when there is demand for water. Holder assembly 90 is mounted to conduit or connector 38 in series with outlet 44 an preferably relatively close to outlet 44. When hot water passes through connector 38 and assembly 90, its temperature is raised causing heat sensitive fragrance tablet 96 to emit its fragrance. In this manner it is only when a user activates valve 60 that fragrance is emitted thus preserving it when there is no use of the bidet facilities such as when there are extended absences.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bidet assembly adapted to be connected to a tap water supply, comprising:

A) a holding tank assembly including an inlet and an outlet, and said inlet adapted to be connected to said tap water supply, and including electric heating means for raising the temperature of the water contained inside said holding tank assembly;

B) a heat sensitive fragrance dispensing assembly mounted on said holding tank assembly so that sufficient heat is transferred to cause said fragrance to become volatile;

C) first conduit means connecting said outlet to a nozzle valve assembly; and

D) electrical energy supply means connected to said electric heating means.

2. The bidet assembly set forth in claim 1 further including:

E) means for adjusting the temperature of the water inside said holding tank assembly.

3. The bidet assembly set forth in claim 2 wherein said tank assembly is insulated and includes a cut-out portion without insulating material where said fragrance dispensing assembly is mounted so that maximum heat transfer is achieved.

4. A bidet assembly adapted to be connected to a tap water supply, comprising:

A) a holding tank assembly including an inlet and an outlet, and said inlet adapted to be connected to said tap water supply, and including electric heating means for raising the temperature of the water contained inside said holding tank assembly;

B) first conduit means connecting said outlet to a nozzle valve assembly;

C) a holder for a heat sensitive fragrance mounted on said first conduit means so that sufficient heat is transferred to said holder to cause said heat sensitive fragrance to become volatile when water goes through said first conduit means; and D) electrical energy supply means connected to said electric heating means.

5. The bidet assembly set forth in claim 4 further including:

E) means for adjusting the temperature of the water.

* * * * *